US006959742B2

(12) United States Patent
Aronson et al.

(10) Patent No.: US 6,959,742 B2
(45) Date of Patent: Nov. 1, 2005

(54) FUEL TRANSFER ADAPTOR

(75) Inventors: Louis V. Aronson, Oldwick, NJ (US); Adam Grabicki, Hopatcong, NJ (US)

(73) Assignee: Ronson Corporation, Woodbridge, NJ (US)

( * ) Notice: Subject to any disclaimer, the term of this patent is extended or adjusted under 35 U.S.C. 154(b) by 144 days.

(21) Appl. No.: 10/356,420

(22) Filed: Jan. 31, 2003

(65) Prior Publication Data

US 2004/0149350 A1 Aug. 5, 2004

(51) Int. Cl.[7] ..... B65B 31/00

(52) U.S. Cl. ..... 141/383; 141/3; 141/20; 141/98; 141/291

(58) Field of Search ..... 141/1, 2, 3, 20, 141/98, 291, 296, 348, 368, 383, 384, 385, 386, 344

(56) References Cited

U.S. PATENT DOCUMENTS 3,224,626 A 12/1965 Zellweger
3,511,266 A 5/1970 Philipot
3,756,273 A 9/1973 Hengesbach
4,077,429 A 3/1978 Kimball
4,128,391 A 12/1978 Braunstein
4,207,934 A * 6/1980 Scremin et al. ..... 141/383
5,533,891 A 7/1996 Pearl et al.
5,934,753 A 8/1999 Lange
6,186,774 B1 2/2001 Butera, Jr.

* cited by examiner

*Primary Examiner*—Justine R. Yu
*Assistant Examiner*—Peter deVore
(74) *Attorney, Agent, or Firm*—Lerner, David, Littenberg, Krumholz & Mentlik, LLP

(57) ABSTRACT

A fuel consumption apparatus includes a container for discharge of a fuel therefrom and a fuel consumption device such as a torch for producing a flame upon igniting the fuel. An adaptor releasably couples the container to the fuel consumption device. The adaptor includes a tightening assembly having an inner locking element and an outer ring rotatable with respect to the inner locking element. The tightening assembly is operable between a locked position and an unlocked position. A holding member releasably engages with a portion of the container when the tightening assembly is in at least the unlocked position. The holding member includes one or more prongs shaped to releasably engage a portion of the container.

68 Claims, 10 Drawing Sheets

FUEL TRANSFER ADAPTOR

BACKGROUND OF THE INVENTION

The present invention relates generally to a fuel consumption device for use with a disposable fuel container. More specifically, the present invention relates to a fuel transfer adaptor that releasably attaches the fuel container and that provides a sealed gas passageway between the fuel container and the fuel consumption device.

Butane is used as fuel in various fuel consumption devices such as butane lighters, soldering torches, ignitors, portable stoves, etc. In some portable applications, butane is stored in a small, air tight, cylindrically-shaped container having an elongated nozzle coupled to a release valve for dispensing the butane fuel. One example of this type of fuel container is Ronson's Multi-Fill® Ultra Butane Fuel.

The vast majority of portable fuel containers are designed to refill the fuel reservoir of a butane lighter. In butane lighter applications, the tip of the butane container nozzle is first inserted into an inlet opening of the reservoir. The release valve of the container is then triggered and butane is discharged into the reservoir. After filling the container with butane, the nozzle is removed from the inlet opening. A perfect seal between the nozzle and the inlet opening is desireable but not vital in achieving the goal of refilling the fuel reservoir. Furthermore, it is not necessary for the butane container to be securely attached to the lighter since the entire refilling process is temporary. A person can hold both the fuel container and the lighter at the same time during the short refilling process.

When fuel stored in this type of container is used with other fuel consumption devices, such as a torch assembly, different design considerations are at issue. Many fuel consumption devices do not have a separate reservoir to store the source of fuel. Instead, the fuel container is attached to the fuel consumption device, and the fuel is supplied directly from the fuel container itself. A reliable seal between the fuel container and the torch assembly is a much more important design criteria as fuel leaks can be very hazardous. Another important design criteria is that the fuel container be securely attached to the fuel consumption device to prevent against accidental disengagement.

One known torch assembly attaches to a portable butane fuel container to form a handheld torch. The torch assembly includes an opening for receiving the nozzle of the fuel container. Within the opening is a pin which is received within the nozzle for triggering the release valve of the fuel container. The torch assembly releasably attaches to the container by a cam tightening assembly. The cam tightening assembly has a plurality of fingers that circumscribe the rim of the container. The fingers apply a radially inward force against the rim to create a friction fit that securely attaches the fuel container to the torch assembly. The magnitude of the force depends on the position of an outer tightening ring, which rotates about an axis. Rotating the ring in one direction (tightening direction) increases the force, and rotating the ring in the opposition direction (releasing direction) decreases the force.

The process of attaching the fuel container begins by rotating the tightening ring in the releasing direction to its most released limit. The nozzle of the fuel container is then inserted into the torch assembly opening so that the pin triggers the release valve of the container. The container is held in a predetermined, pre-attached position with respect to the torch assembly. The tightening ring is then rotated in the tightening direction so that the fingers clamp onto the rim of the container. The process of releasing the container from the torch assembly is by rotating the tightening ring in the releasing direction until the fingers are released. The user of the device can then separate the fuel container from the torch assembly.

This aforementioned device has a number of disadvantages. First, the process of attaching the fuel container to the torch assembly requires the cam assembly to be in a released configuration before the other steps are performed. Forcing a fuel container onto the torch assembly when the cam assembly is not in a released configuration may damage the torch assembly. Second, the fuel container must be held in a predetermined assembled position by the user before and while the tightening ring is rotated. Finally, even after the torch assembly is attached to the container, it is still possible for the container to become accidentally disengaged by a strong force applied to the container.

There therefore exists a need for a fuel transfer adaptor that provides a reliable seal between a fuel container and a fuel consumption device and that also solves the described problems of the known device.

SUMMARY OF THE INVENTION

The present invention is directed towards a fuel transfer adaptor that is capable of being releasably attached to a fuel container and that provides a sealed gas passageway between the fuel container and the fuel consumption device. The adaptor is designed to couple with a fuel container that has a nozzle for releasing the fuel.

In accordance with the invention, the adaptor includes a cam tightening assembly which attaches to the fuel container by flexible fingers that clamp down on the container when a tightening ring is rotated. The cam assembly of the present invention includes a spring coupled to the tightening ring to force the ring into a released configuration when it is in its free state, e.g., when it is not attached to the container. The cam assembly fingers are also shaped to have undercuts to accept a portion of the fuel container, e.g., the container rim, to achieve the correct installation position while the tightening ring is rotated.

The adaptor also includes a holding member shaped to have a plurality of prongs that engage the fuel container. The prongs hold the container in a position suitable for further attachment by the cam tightening assembly. The holding member cooperates with the cam assembly fingers when the tightening ring is rotated and prevents against the accidental disengagement of the container.

The adaptor also includes a gasket that presses against the fuel container to form a gas tight enclosure that surrounds the base of the container nozzle. This gasket is used to prevent the release of fuel that may escape through the nozzle base and also the fuel that may have leaked passed other seals present in the adaptor.

In accordance with one embodiment of the present invention there is described an adaptor for receiving fuel from a fuel container having an elongated nozzle and a fuel reservoir, the container having a recess surrounding the elongated nozzle. The adaptor includes a body member shaped to define a passageway for receiving the elongated nozzle, the passageway capable of communicating with the fuel reservoir when the adaptor is coupled to the container, a holding member shaped to engage the container recess to hold the container in a predetermined position with respect to the body member, and a compressible sealing member positioned to provide a gas tight seal between the container and the body member when the fuel container is in the predetermined position, the seal circumscribing an interface between the nozzle and the body member.

In accordance with another embodiment of the present invention there is described an adaptor for receiving fuel from a fuel container having an elongated nozzle and a fuel reservoir. The adaptor includes a cam tightening assembly having an inner locking element with a plurality of flexible arms and an outer ring rotatable with respect to the inner locking element, the locking element being positioned at least partly within the ring; the tightening assembly having at least two configurations, a tightened configuration and a released configuration, the configurations dependent on the position of the outer ring with respect to the locking element, a guiding element positioned adjacent to the inner locking element, the guiding element restricting the movement of the plurality of flexible arms in a longitudinal direction.

In accordance with another embodiment of the present invention there is described a cam tightening assembly for removeably attaching a fuel container having an elongated nozzle and a fuel reservoir, the assembly includes an inner locking element having a plurality of flexible arms and capable of circumscribing a portion of the container for attachment to the assembly; an outer ring rotatable with respect to the inner locking element to define at least two configurations, a tightened configuration and a released configuration; and a spring coupled to the inner locking element and the outer ring so as to impart a force against the outer ring in a direction from the more tightened configuration to the released configuration.

In accordance with yet another embodiment of the invention, there is described a fuel transfer adaptor for receiving fuel from a container having an elongated nozzle with a tip and a base, the adaptor comprises an opening for receiving the nozzle, an o-ring positioned within the opening and adapted to circumscribe the nozzle, a gasket shaped and positioned to create a gas tight enclosure that encompasses the base of the nozzle, and means for attaching the adaptor to the container.

In accordance with one embodiment of the present invention there is described an adaptor for releasably securing a container having a fuel reservoir and an elongated nozzle for discharge of fuel therefrom to a fuel consumption device, the container having a recess at one end of the container, the adaptor comprising a body member having a passageway for receiving the elongated nozzle, the passageway adapted for communicating between the fuel reservoir and the fuel consumption device when the adaptor is coupled to the container; and a holding member attached to the body member and shaped to engage the container recess for securing the container in a predetermined position with respect to the body member.

In accordance with one embodiment of the present invention there is described an adaptor for releasably securing a container having a fuel reservoir to a fuel consumption device, the adaptor includes a tightening assembly including an inner locking element and an outer ring rotatable with respect to the inner locking element; the tightening assembly having at least two configurations, a tightened configuration and a released configuration, the configurations dependent on a position of the outer ring with respect to the locking element; and a holding member arranged inwardly of the flexible arm, the holding member adapted for releasable engagement with a portion of the container when the tightening assembly is in at least the released configuration.

In accordance with one embodiment of the present invention there is described a fuel consumption apparatus for producing a flame, the apparatus includes a container for discharge of a fuel therefrom, a fuel consumption device for producing a flame upon igniting the fuel, and an adaptor for releasably coupling the container to the fuel consumption device, the adaptor including a tightening assembly having an inner locking element and an outer ring rotatable with respect to the inner locking element, the tightening assembly operable between a locked position and an unlocked position, and a holding member adapted for releasable engagement with a portion of the container when the tightening assembly is in at least the unlocked position.

BRIEF DESCRIPTION OF THE DRAWINGS

In accordance with yet another embodiment of the present invention, there is a method for releasably securing a container having a fuel reservoir to a fuel consumption device, the method comprising providing a tightening assembly having an inner locking element and an outer ring rotatable with respect to the inner locking element, the tightening assembly having a tightened configuration and a released configuration dependent on a position of the outer ring relative to the inner locking element, providing a holding member inwardly of the inner locking element, arranging the tightening assembly in the released configuration, engaging a portion of the container within the holding member with the tightening assembly in the released configuration, and rotating the outer ring relative to the inner locking element for arranging the tightening assembly in the tightened configuration.

DETAILED DESCRIPTION

In describing the preferred embodiments of the present invention, specific terminology will be resorted to for the sake of clarity. However, the invention is not intended to be limited to the specific terms so selected, and is understood that each specific term includes all technical equivalence which operate in a similar manner to accomplish the same purpose.

Figure 1:
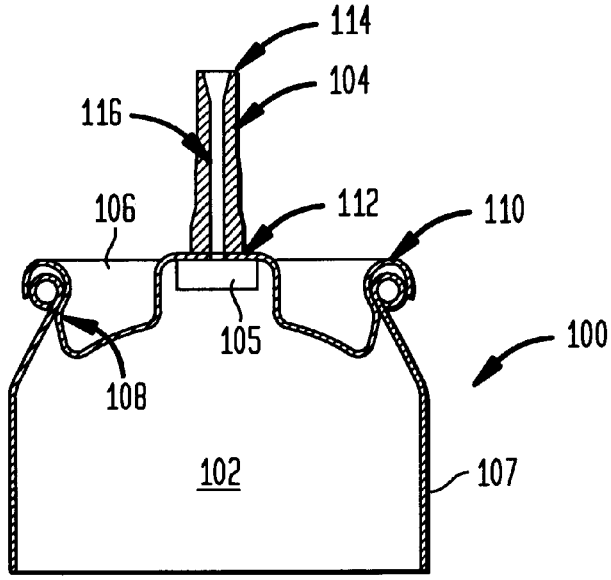
FIG. 1 is a cross-sectional view of one example of a fuel container that may be used with the fuel transfer adaptor of the invention.

Referring now to the drawings, wherein like reference numerals represent like elements, there is shown in FIG. 1 an engagement end of a fuel container 100. The fuel container 100 includes a fuel chamber 102 for storing butane or other combustible fuel, a nozzle 104 for dispensing the butane and a valve 105 that controls the flow of butane out of the container 100. The fuel chamber 102 is preferably formed of a metal wall 107 or other strong material, and the nozzle 104 is preferably made of plastic. The fuel chamber 102 is shaped to include a recess 106 having a circular engaging portion 108 and a circular rim 110 surrounding the recess 106. The recess 106 is preferably shaped so that the rim 110 at least partially overhangs the engaging portion 108.

The nozzle 104 of the container 100 is generally in the form of an elongated shaft with a base 112, a tip 114, and a passageway 116 that spans the entire length of the nozzle 104. The passageway 116 connects an interior of the fuel chamber 102 to the tip 114 of the nozzle 104. Coupled to the nozzle 104 is the valve 105. The valve controls the flow of butane out of the container 100. The valve is coupled to the nozzle 104 is that butane is released from the chamber 102 when the nozzle 104 is pushed axially towards the chamber 102. Other container designs may be used with the inventive adaptor. For example, in some embodiments of the invention, th e container may have a valve that is coupled to release butane when a pin or other structure is inserted into the nozzle passageway for piercing a septum that releases the butane. Alternatively, the container can store other fuels besides butane, for example, it can store propane.

Figure 2:
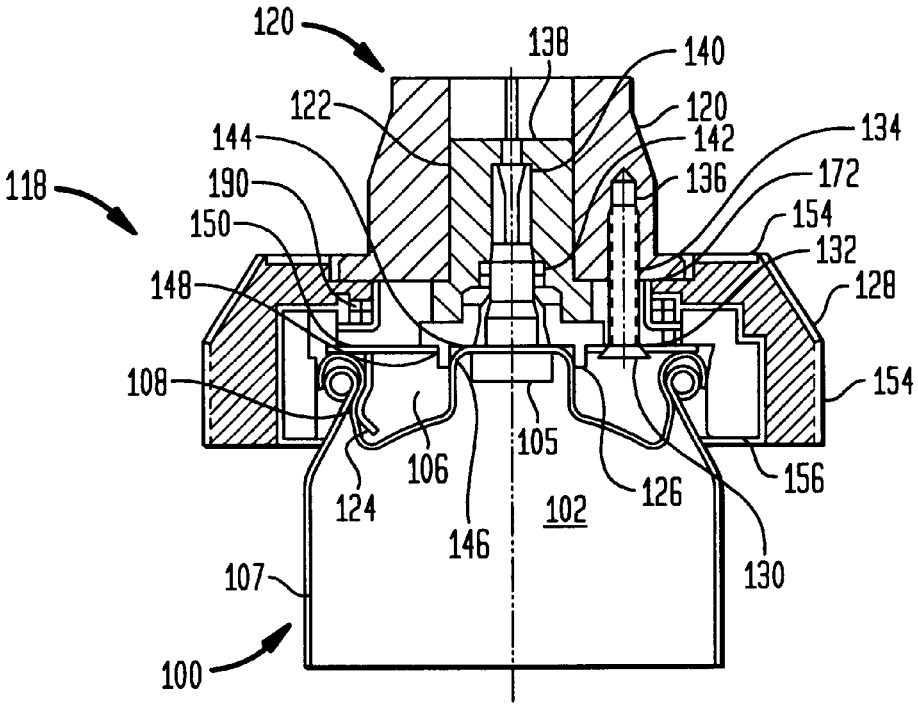
FIG. 2. is a cross-sectional view of one embodiment of an adaptor that is attached to the fuel container of FIG. 1.

Referring now to FIG. 2, a fuel transfer adaptor 118 is shown releasably attached to the fuel container 100 and coupled with a fuel consumption device 120. The adaptor 118 includes a metal sleeve 122, a center holder 124, a rubber gasket 126 positioned between the center holder 124 and the metal sleeve 122, and a cam assembly 128. The adaptor 118 is fastened to the consumption device 120 by three screws 130, which are received by three openings 132 in the center holder 124 and three openings 134 in the cam assembly 128. The screws 130 are anchored in threaded blind holes 136 in the consumption device 120.

The metal sleeve 122 has a linear passageway 138 shaped to receive the nozzle 104 of the container 100. The passageway 138 includes an inner ledge 140, which is designed to abut against the tip 114 of the container 100 when the container 100 and the adaptor 118 are attached together. The ledge 140 serves to trigger the valve 105 of the container 100 by pushing the nozzle 104 towards the chamber 102. In the alternative, the adaptor can include a pin (not shown) that is positioned within the passageway 138 so that the pin is inserted into the nozzle passageway 116 when the container 100 is coupled to the adaptor 118. The pin triggers the release of butane.

Within the passageway 138 are two o-rings 142, which are sized to frictionally mate with an outer diameter of the nozzle 104. The o-rings 142 create a first set of gas tight seals against the nozzle 104 for preventing the escape of butane.

The ring shaped gasket 126 also assists in preventing the release of butane when the adaptor 118 is attached to the container 100. The gasket 126 is shaped to receive the nozzle 104 of the container 100 and provides a second set of seals 144, 146. The two seals 144, 146 are circular and are located against the chamber wall 107 of the container 100. The first seal 144 is formed on an upper flat portion of the chamber wall 107, and the second seal 146 is formed within the recess 106 of the chamber wall 107. Both seals 144, 146 circumscribe the base 112 of the nozzle 104 to form a gas tight enclosure that encompasses the base 112 of the nozzle 104. In some instances, butane may be released at the base 112 of the nozzle 104 when the container valve is triggered.

The ring shaped gasket 126 is held in place by the metal sleeve 122 and the center holder 124, which is attached to the fuel consumption device 120 by the three screws 130. The gasket 126 is preferably press-fitted against a central major opening 148 of the center holder 124. The gasket 126 is preferably formed of rubber or an alternative polymer and relatively gas-impermeable material.

Figure 3A:
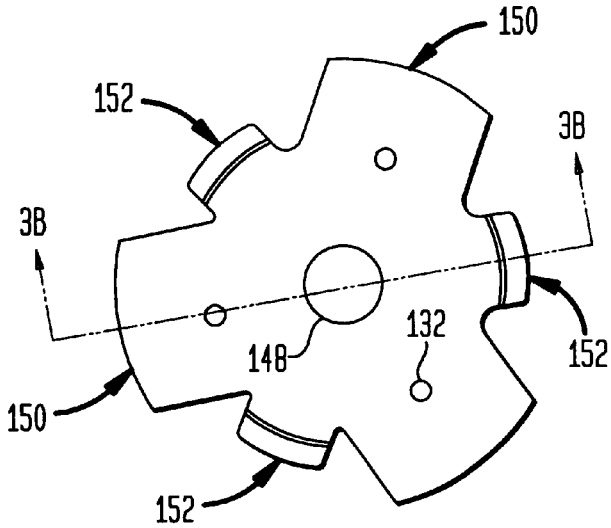
FIG. 3A is a bottom plan view of one embodiment of a center holder of the invention.
Figure 3B:
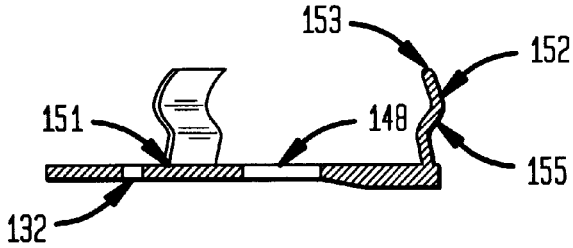
FIG. 3B is a bottom plan view taken along reference line 3B—3B of FIG. 3A.
Figure 3C:
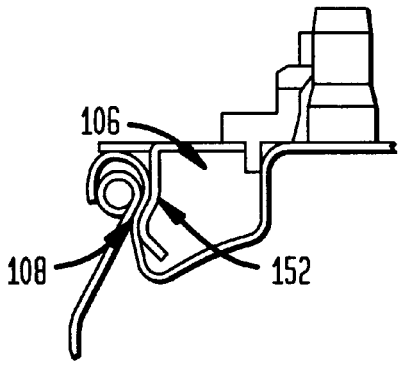
FIG. 3C is a partial cross-sectional view of a center holder attaching a container to an adaptor.
Figure 4A:
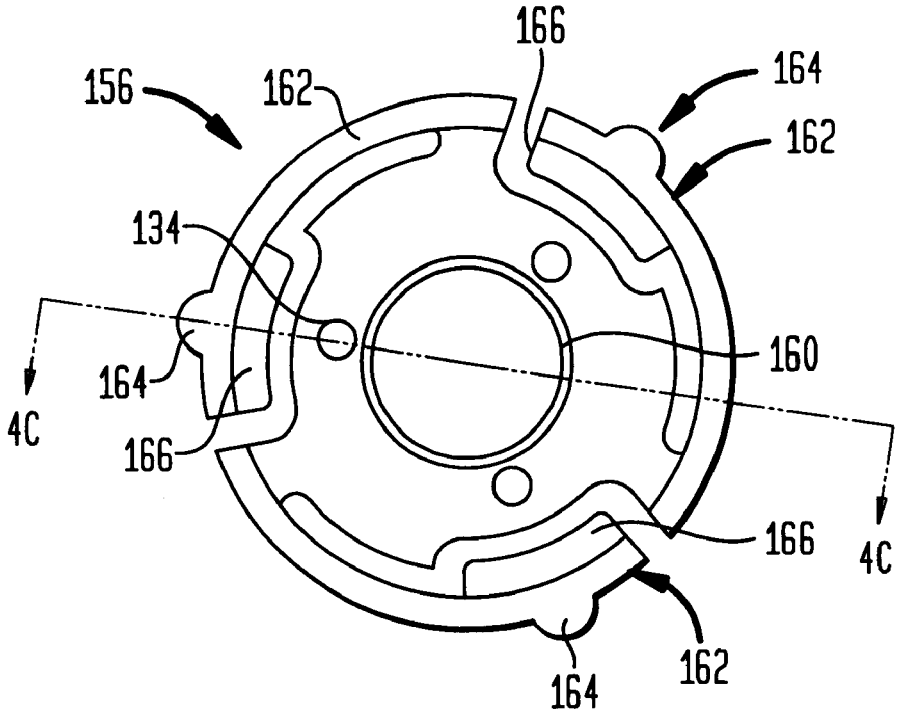
FIG. 4A is a bottom plan view of one embodiment of a locking element according to the invention.
Figure 4B:
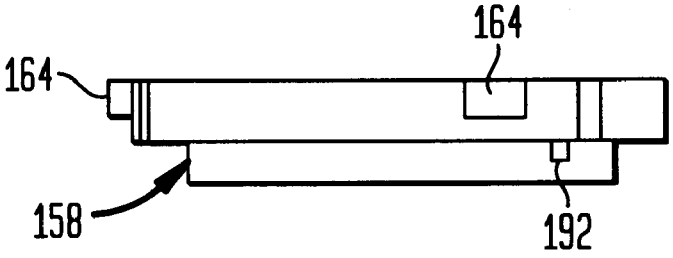
FIG. 4B is a side elevational view of the locking element of FIG. 4A.
Figure 4C:
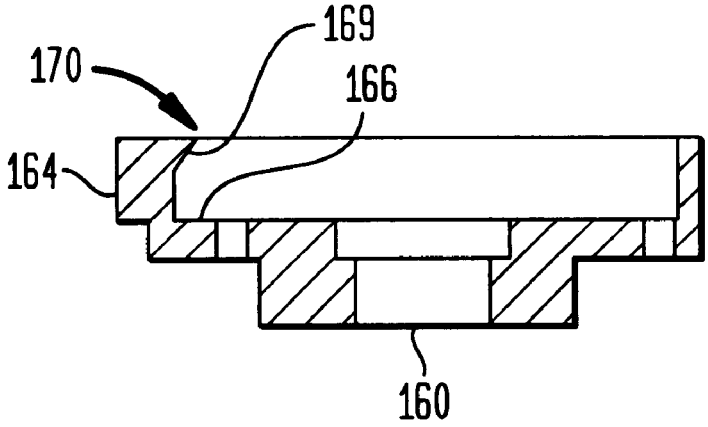
FIG. 4C is a cross-sectional view taken along reference line 4C—4C of FIG. 4A.
Figure 4D:
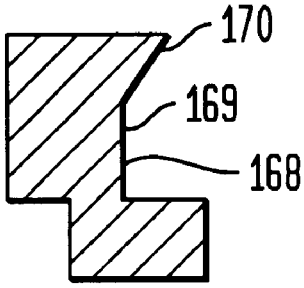
FIG. 4D is an enlarged, partial cross-sectional view of the locking element showing a profile of an engagement surface.

Referring now to FIGS. 3A, 3B, and 3C, the center holder 124 is shaped to have three guiding members 150 and three circumferentially-positioned prongs 152, each having a base 151, a tip 153, and an engaging curved portion 155 therebetween. At the center of the center holder 124 is the major opening 148, which, as explained above, is adapted to receive the gasket 126. The center holder 124 is also shaped to provide the three openings 132 for receiving the three screws 130 that are used to fasten the adaptor 118 to the consumption device 120. The center holder 124 is preferably formed of a single piece of sheet metal, which is first stamped and then bent to form the prongs 152.

The prongs 152 of the center holder 124 prevent the accidental disengagement of the adaptor 118 from the container 100. As best illustrated in FIG. 3C, the three prongs 152 engage the engaging portion 108 of the container recess 106 to hold the container 100 in place. In their relaxed state, the prongs 152 extend generally downward. As the container 100 is being attached to the adaptor 118, the prongs 152 are bent radially inward by the container rim 110. The resiliency of the prongs 152 imparts a force against the container 100 in the radially outward direction. The shape of the prongs 152 are such that when the rim 110 passes the engaging portion 155 of the prongs 152, the prongs 152 snap back towards their relaxed state and continue to impart a force against the container 100. At the same time, the shape of the prongs 152 are such that it forces the top chamber wall 107 of the container 100 against the gasket 126 to product the gas-tight seals 144, 146. The shape of the container rim 110 prevents the container 100 from becoming easily uncoupled.

The guiding members 150 of the center holder 124 are generally flat wall members that extend out from the center of the center holder 124. As explained in more detail hereinafter, the guiding members 150 together with the cam assembly 128 provide for the secure attachment of the container 100 and protect against unintentional disengagement. The guiding members 150 can have a wide variety of shapes and sizes.

The center holder 124 holds and positions the container 100 for further attachment by the cam assembly 128. The container 100 should be properly aligned with respect to the adaptor 118 before tightening the cam assembly 128. As explained in more detail below, the cam assembly 128, when tightened, forms a friction fit against the rim 110 of the container 100. A misalignment may produce a weak fit or may cause damage to the container 100 and the adaptor 118.

Although the described center holder 124 shows three equally spaced prongs 152 and three guiding members 150, the center holder 124 can have more or less than three prongs 152 and guiding members 150 without departing from the invention. Furthermore, the prongs 152 need not be equally spaced from each other.

FIGS. 4–5 show different views of two components of the cam assembly 128, an outer tightening ring 154 and an inner locking element 156. When assembled, the inner locking element 156 is fixedly attached to the rest of the adaptor 118 and the outer tightening ring 154 rotates with respect to the locking element 156. As explained in more detail below, the cam assembly 128 attaches to and releases the fuel container 100 by rotating the tightening ring 154.

Referring to FIGS. 4A, 4B, 4C and 4D, the inner locking element 156 is shaped to have a circular, disk-shaped base 158 with a central major opening 160. The inner locking element 156 also includes the three openings 134 for receiving the three screws 130 used to fasten the adaptor 118 to the consumption device 120. The inner locking element 156 also includes three flexible fingers 162 that are attached to the base 158. The finger 162 are designed to flex in the radially inward direction.

The tips of the fingers 162 are each shaped to each have a detent 164 that projects radially outward and a flange 166 that projects radially inward. Proximal to and on the same side of each flange 166 is an engagement surface 168. Each engagement surface 168 is shaped to have a recess 169 adjacent to undercut 170 that extends radially inward from the rest of the engagement surface 168. As explained in more detail below, the engagement surface 168 is shaped to guide the container 100 into the proper position as the cam assembly 128 clamps onto the rim 110 of the container 100.

Figure 5A:
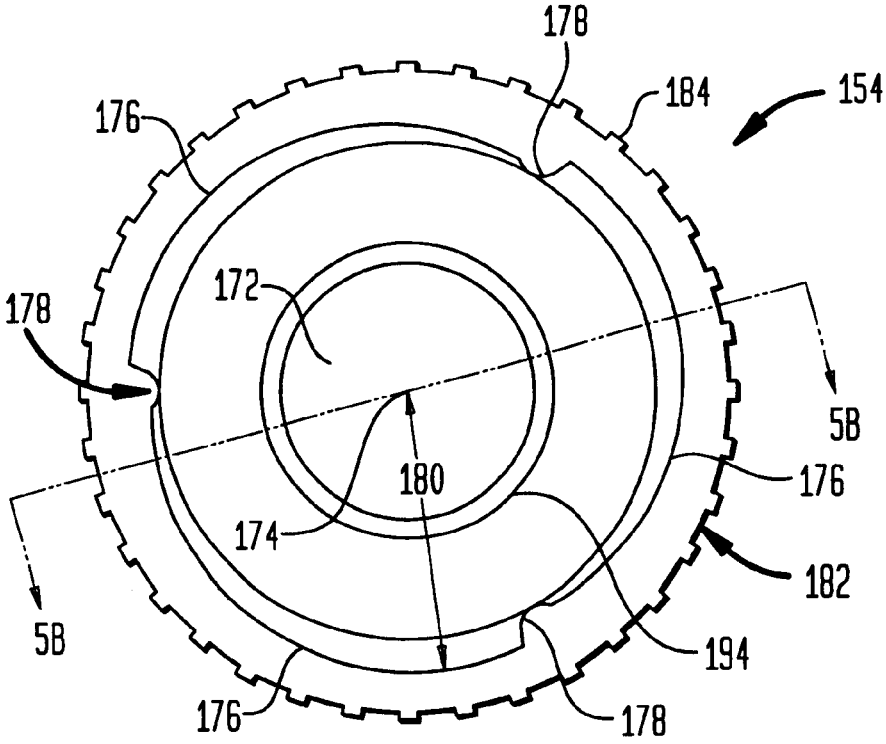
FIG. 5A is a bottom plan view of one embodiment of a tightening ring according to the invention.
Figure 5B:
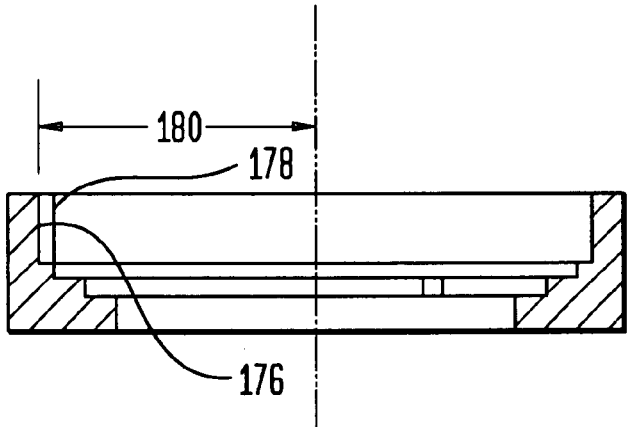
FIG. 5B is a cross-sectional view taken along reference line 5B—5B of FIG. 5A.

Referring to FIGS. 5A and 5B, the outer tightening ring 154 is generally washer-shaped with an opening 172 at its center 174. The tightening ring 154 also includes continuous inner engaging surfaces 176 with a detent 178 at each end thereof. A distance 180 between the engaging surface 176 and the center 174 varies circumferentially between each detent 178. This variation provides the cam functionality of the cam assembly 128. Preferably, the variation in the distance 180 is gradual and in one direction between each detent 178. The tightening ring 154 also has an outer gripping surface 182 with ridges 184. The ridges 184 assist the user to grip the ring 154 and tighten the cam assembly 128.

Figure 6A:
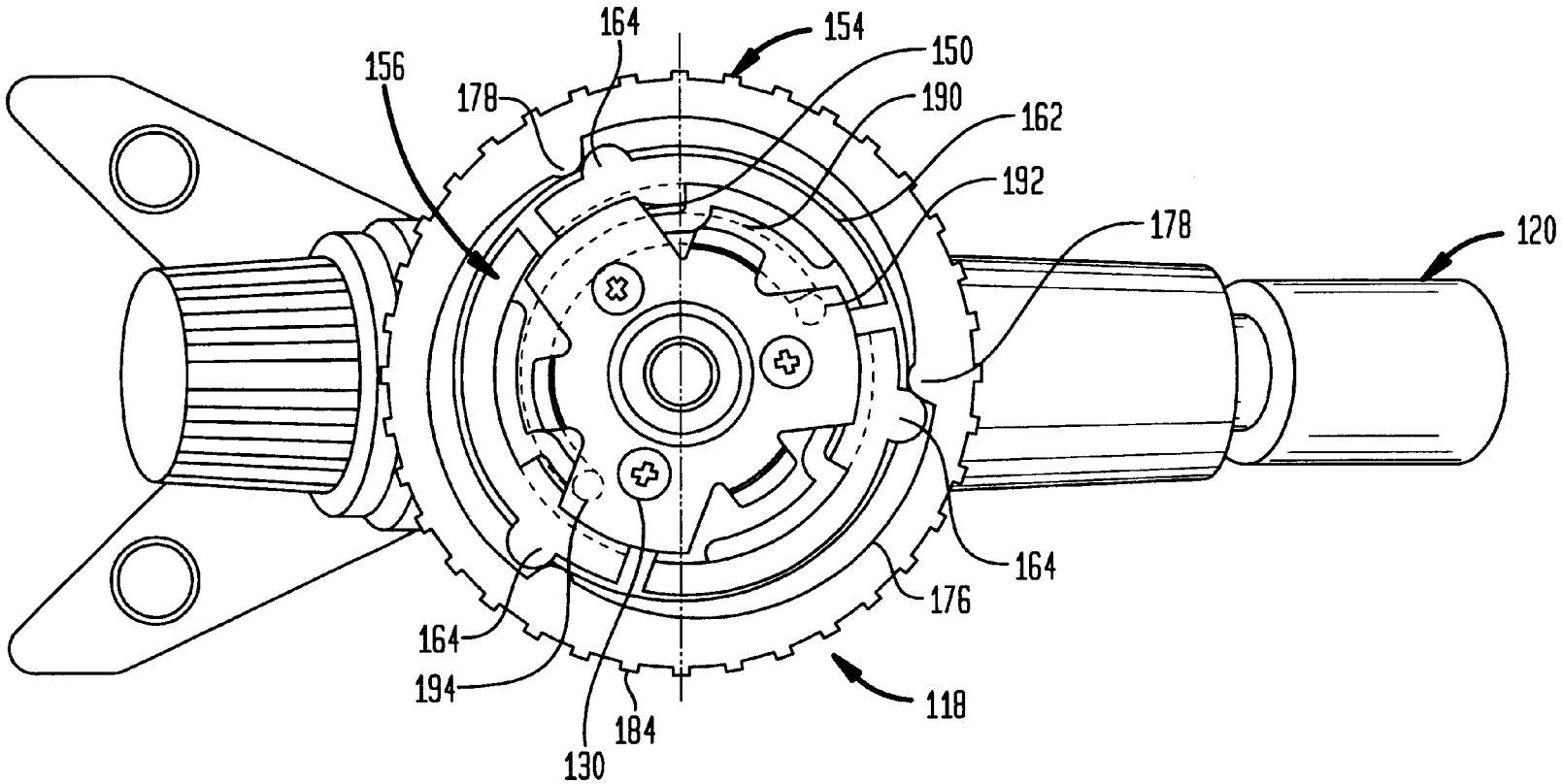
FIG. 6A is a bottom plan view of a fuel transfer adaptor coupled to a fuel consumption device in a released configuration.
Figure 6B:
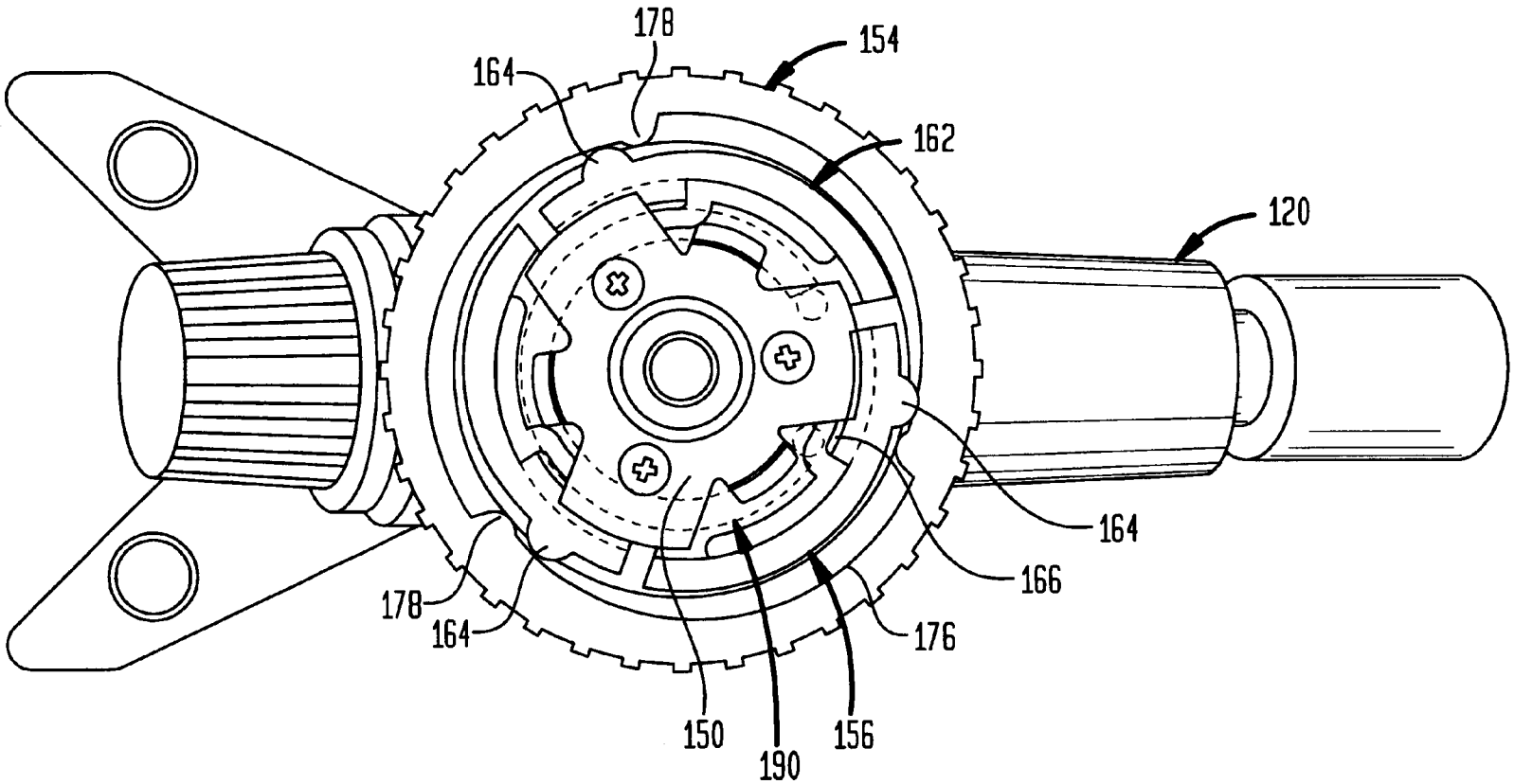
FIG. 6B is a bottom view of the fuel transfer adaptor coupled to a fuel consumption device in a tightened configuration.

Referring now to FIGS. 6A and 6B, bottom views of the adaptor 118 illustrate the design and operation of the cam assembly 128. The tightening ring 154 is rotatable with respect the stationary locking element 156. As the tightening ring 154 rotates counterclockwise, the adaptor is 118 is placed from a released configuration (FIG. 6A) to a tightened configuration (FIG. 6B). The released configuration correlates to the range of positions of the tightening ring 154 where the container 100 can be easily separated from the adaptor 118, and the tightened configuration correlates to the range of position where the container 100 is securely attached to the adaptor 118.

As the cam assembly 128 is tightened, the engaging surfaces 176 of the tightening ring 154 press against the detents 164 of the locking element 156 and force the fingers 162 in the radially inward direction. As the fingers 162 are forced radially inward, the fingers 162 press against the fuel container rim 110 to produce a strong friction fit. When the adaptor 118 is in a tightened configuration, the rim 110 is positioned within the recesses 169 of the engaging surface 168 and the finger undercuts 170 extend over the rim 110. The undercuts 170 prevents the rim 110 from sliding in a direction that results in the unintentional disengagement of the container 100.

The finger undercuts 168 also assist in attaching the container 100 to the adaptor 118. As discussed above, the prongs 152 of the center holder 124 hold and align the container 100 prior to the tightening of the cam assembly 128. As the cam assembly 128 is tightened, the fingers 162 move radially inward and the finger undercuts 168 guide the rim 110 into the recesses 169 of the engaging surface 168.

The adaptor 118 is designed to prevent the container 100 from being uncoupled when a strong force is placed against the container 100. A container attached to an adaptor by a cam tightening assembly may become disengaged when a strong force is placed on the container. The force may bend one or more of the fingers of the cam assembly in the axial direction and allow for the container rim to slip out. The inventive adaptor 118 solves this problem by using the guiding members 150 of the center holder 124 to restrict the bending the fingers 162 in the axial direction.

In this regard, the flanges 166 of the fingers 162 are contained and held within a space underlying the guiding members 150 of the center holder 124, See FIG. 6B. The flanges 166 and their containment by the guiding members restrict the bending of the fingers 162 in the axial direction. Although the guiding member 150 of the present embodiment is a relatively flat wall structure, the guiding member 150 can be a variety of other shapes as long as it generally limits the direction by which the fingers 162 may bend.

The detents 178 of the tightening ring 154 and the detents 164 of the locking element 156 define the two limits by which the tightening ring 154 can be rotated. The detents 164,178 prevent the tightening ring 154 from rotating beyond either of the two limits. The cam assembly 128 applies a gradually increasingly force against the container rim 110 as the tightening ring 154 is rotated in the tightening direction from one limit to the other limit. This can be accomplished by designing the shape of the tightening ring engaging surface 176. The engaging surface distance 180 determines the degree by which the fingers 162 are bent radially inward with generally a smaller distance correlating to a larger degree of bending by the fingers 162. A tightening ring 154 having a engaging surface distance 180 that varies uniformly from one detent 178 to the next detent 178 will result in cam assembly 128 that applies an increasing greater force against the container rim 110 as the tightening ring 154 is rotated in the tightening direction. In the alternative and by the same design principles, the cam assembly 128 can be designed to gradually tighten from a released configuration to a certain predetermined degree of tightness and then level off as the tightening ring 154 is rotated further.

The adaptor 118 may include an automatic release feature that places the cam assembly 128 in a released configuration when it is in its free state, e.g., not attached to a container 100. In accordance with one embodiment, a spring 190 (See FIG. 6B) is coupled to both the locking element 156 and the tightening ring 154 by anchoring one end of the spring 190 onto a protrusion 192 formed proximal the base 158 of the locking element 156 and the other end onto a protrusion 194 formed proximal the opening 172 of the tightening ring 154. The spring 190 wraps around the outer portion of the locking element base 158.

When the cam assembly 128 is uncoupled from the container 100, the spring 190 forces the cam assembly 128 into a relaxed configuration. Preferably, the cam assembly 128 is designed so there is relatively little interference between the locking element 156 and the tightening ring 154 when the cam assembly 128 is in its free state. In this way, the adaptor 118 will be in a relaxed configuration prior to the attempted coupling of the cam assembly 128 to the fuel container 100. When the cam assembly 128 is coupled to the container 100 and placed in a tightened configuration, the friction created by the tightening resists the force of the spring 190 and the cam assembly 128 remains in the same tightened configuration.

One purpose of having a cam assembly 128 that is biased towards a relaxed configuration is to allow the fingers 162 to receive without interference the container rim 110 into the adaptor 118. However, in the absence of the container 100, it is possible that the tightening ring 154 when rotated a significant degree, will frictionally engage the fingers 162 whereby the return spring force will be insufficient to return the tightening ring to its original position. In other words, the tightening ring 154 may not return over its entire range of rotation. Preferably, the cam assembly 128 is sized so that the rim 110 of the container 100 spreads the fingers 162 radially outward when the container 100 is placed in its preferred pre-tightened position. This is achieved by biasing the fingers 162 radially inward as shown in FIG. 7.

Figure 7:
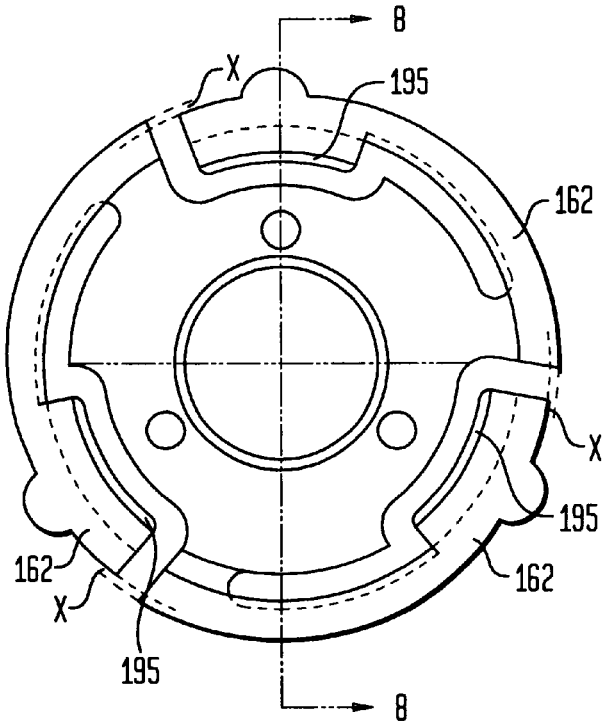
FIG. 7 is a bottom plan view of another embodiment of a locking element according to the invention.
Figure 8:
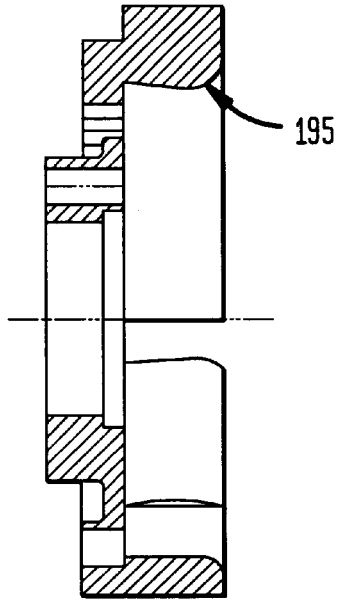
FIG. 8 is a cross-sectional view taken along reference line 8—8 of FIG. 7.

Referring to FIGS. 7 and 8, the fingers 162 in accordance with the preferred embodiment are biased radially inward by a distance designated by the letter X. This distance is sufficient to place the inner edges of the fingers 162 into an interfering relationship with the container rim 110. To this end, the inner edges of the fingers 162 are formed as rounded edges 195. As a container 100 is inserted into the adapter 118, the container rim 110 will engage the rounded edges 195 flexing or spreading the fingers 162 radially outward to accommodate the container. The container 100 is subsequently locked into the adapter 118 by rotation of the tightening ring 154 as previously described.

When the container 100 is removed from the adapter 118, the fingers 162 will naturally flex or expand radially outward to their original position as shown in FIG. 7. The radially inward biasing of the fingers 162 by distance X is sufficient to allow the tightening ring 154 to generally freely rotate without engaging the fingers a sufficient amount whereby the frictional engagement will be insufficient to prevent return of the tightening ring by action of the spring 190. Accordingly, the tightening ring 154 will return to its inoperative state even if inadvertently rotated by the user into a tightened condition in the absence of a container 100 being received within the adapter 118.

In the above embodiments, the cam functionality is based on the inner surface distance 180 of the tightening ring 154. However, the cam functionality can be the result of the shape of the inner locking element 156 as well as the tightening ring 154. The locking element 156 can have fingers 162 that gradually increase in thickness from their bases to their tips so that the outer diameter of the locking element 156 increases likewise. The detents 178 of the tightening ring 154 press against the outer diameter of the locking element 156 to force the fingers 162 radially inward as the tightening ring 154 is rotated in the tightening direction.

The illustrated embodiments have three locking element fingers 162 that form a dissected, circular ring to engage the rim 110 of the container 100. This results in cam assembly 128 with a tightening ring 154 that can be rotated approximately 100 degrees from one end to the other. In the alternative, the locking element 156 can have more or less fingers and can be rotated through a wide variety of angles without departing from the invention.

Figure 9:
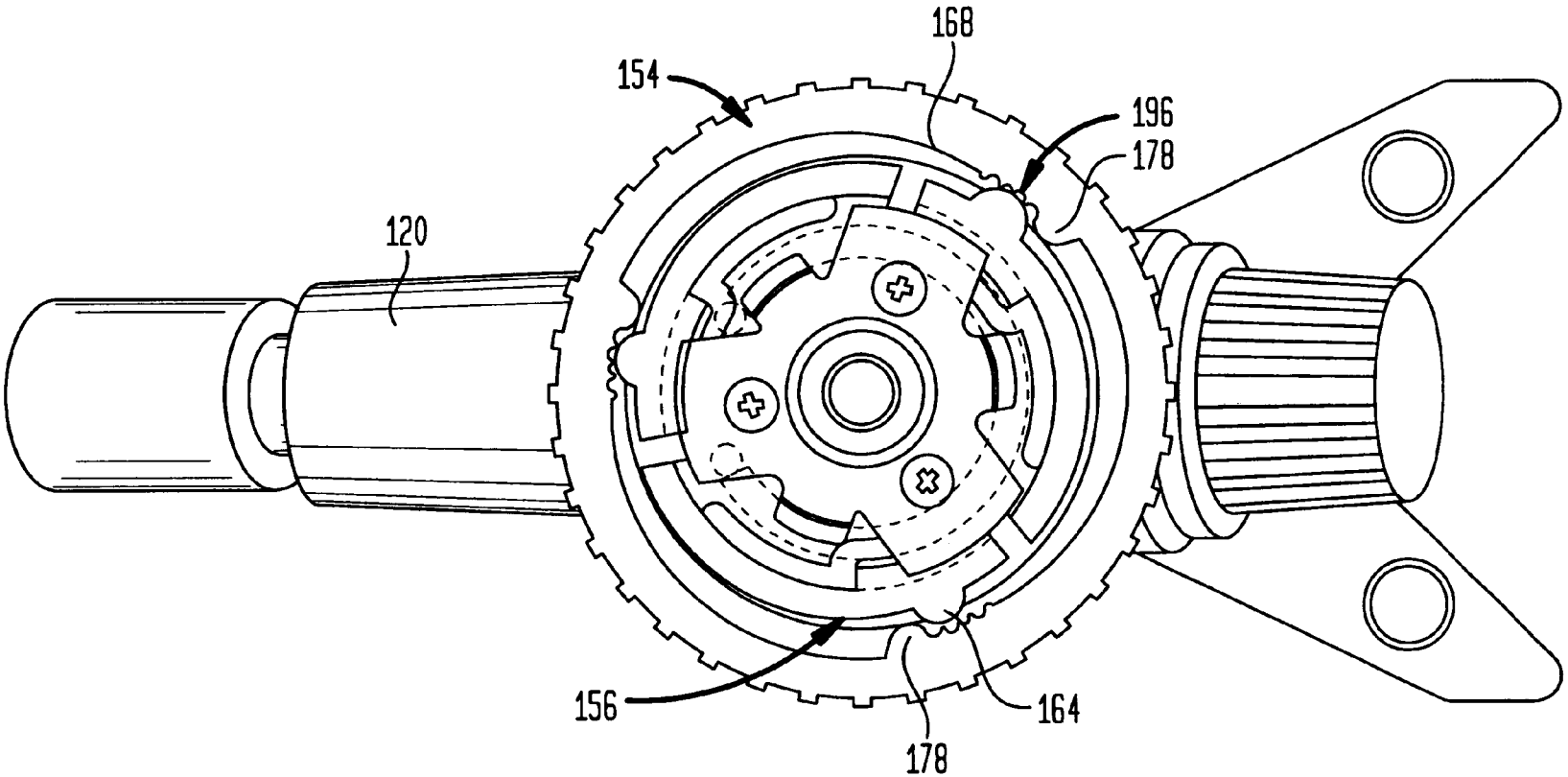
FIG. 9 is a bottom plan view of an alternative embodiment of the invention.

Referring now to FIG. 9, in an alternative embodiment similar to the embodiment of FIG. 6, a tightening ring is shaped to have minor protrusions 196 on its engaging surface 168. Unlike the detents 178 of the tightening ring 154, the protrusions 196 do not limit the tightening ring 154 from rotating further. Instead, the protrusions 196 produce a signal such as a ratcheting sound or a feelable vibration in the tightening ring 154 to signal to the user that the cam assembly 128 is close to its most tightened configuration.

Figure 10:
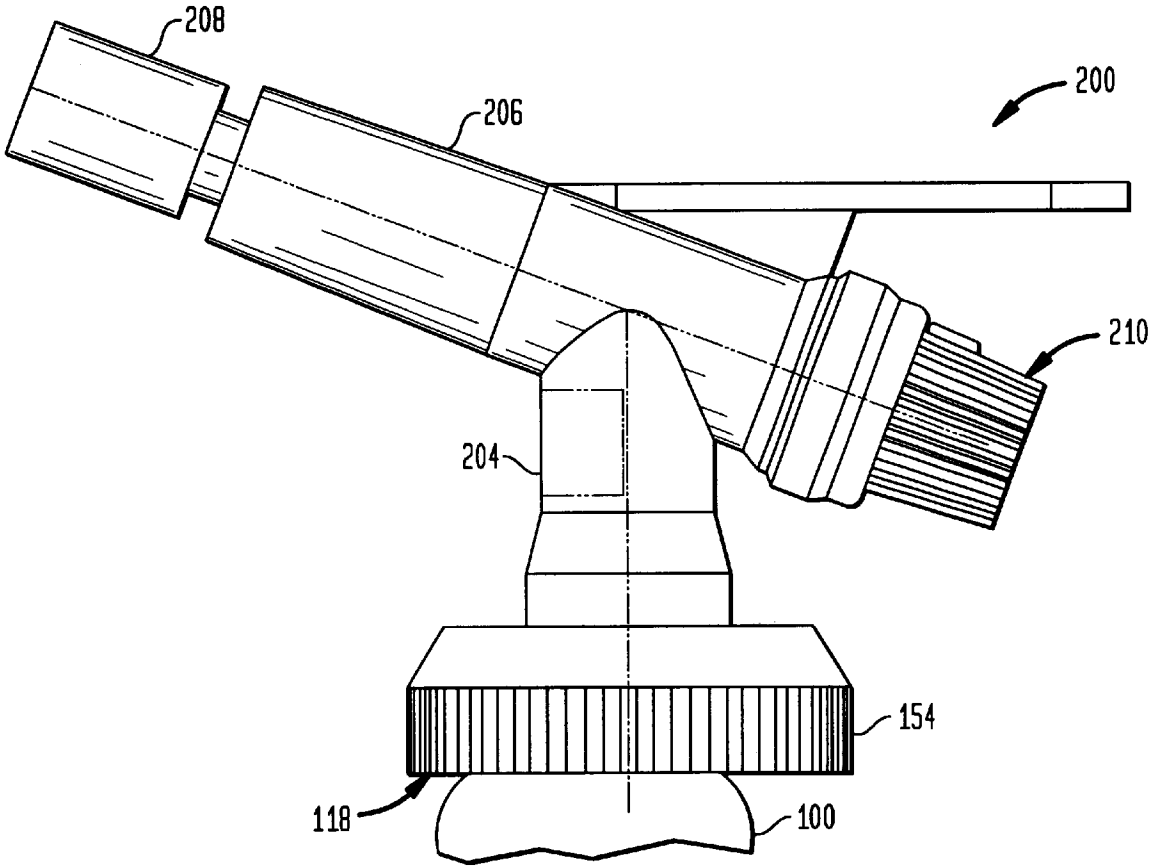
FIG. 10 is a side view of a torch adaptor incorporating the inventive adaptor.

Referring now to FIG. 10, a fuel-burning torch 200 having a fuel transfer adaptor 118 according to the invention is shown. The torch 200 includes the inventive fuel transfer adaptor 118 attached to a butane container 100. The butane torch 200 is only one example of a fuel consumption device. The butane torch 200 includes a stem 204 coupled to a barrel 206 having a flame burner tip 208. Butane supplied by the container 100 is transferred through passageways in the stem 204 and the barrel 206. The flow of butane through the torch 200 is regulated by a valve 210 located on the opposite end of the barrel 206 to the tip 208. The valve 210 is used to control the size of the flame that is directed out through the burner tip 208 by regulating the butane flow through from the container 100. The torch 200 can include an igniter for igniting the flame or, in the alternative, the flame can be ignited by a match. Other designs of butane torches are known in the art and may be used with the adaptor 118 as well.

Although the invention herein has been described with reference to particular embodiments, it is to be understood that these embodiments are merely illustrative of the principles and applications of the present invention. It is therefore understood that numerous modifications may be made to the illustrative embodiments and that other arrangements may be devised without departing from the spirit and scope of the present invention as defined by the appended claims.

We claim:

1. An adaptor for releasable securing a container having a fuel reservoir and an elongated nozzle for discharge of fuel therefrom to a fuel consumption device, the container having a recess at one end of the container, the adaptor comprising:

a body member having a passageway for receiving the elongated nozzle, said passageway adapted for communicating between the fuel reservoir and the fuel consumption device when the adaptor is coupled to the container;

a holding member attached to said body member and shaped to engage the container recess for securing the container in a predetermined position with respect to said body member with said nozzle received within said passageway; and a tightening assembly having an inner locking element and an outer ring rotatable with respect to said inner locking element, said tightening assembly operative between a locked and unlocked position to press said inner locking element against the container with a force that is dependent on a position of said outer ring with respect to said inner locking element, said tightening assembly including a spring applying a rotating force to said outer ring in a direction towards said unlocked position.

2. An adaptor as in claim 1, further including a compressible sealing member positioned to provide a gas tight seal between said body member and the container circumscribing said nozzle when the container is in said predetermined position.

3. An adaptor as in claim 1, wherein said holding member includes at least one prong shaped to engage the container recess.

4. An adapter as in claim 3, further comprising a plurality of prongs each of which are circumferentially positioned with respect to each other.

5. An adaptor as in claim 1, further comprising at least one o-ring positioned within said passageway for providing a gas tight seal around the nozzle when said container is in said predetermined position.

6. An adaptor as in claim 1, wherein said passageway includes an inner ledge, said inner ledge adapted to abut against the elongated nozzle when said container is in said predetermined position.

7. An adaptor as in claim 1 wherein said spring force is sufficient to place said outer ring in said unlocked position when the adaptor is not coupled to the container and is insufficient to rotate said outer ring from said locked position when the adaptor is coupled to the container.

8. An adaptor as in claim 1 wherein said locking element circumscribes a cylindrical portion of the container when the adaptor is coupled to the container.

9. An adaptor as in claim 8 wherein said locking element includes an arm that is flexible in the radially inward direction.

10. An adaptor as in claim 8 wherein said locking element includes a plurality of arms that are each flexible in the radially inward direction.

11. An adaptor as in claim 10 wherein a portion of said locking element is positioned between said holding element and said body member, said holding element restricting the movement of said plurality of arms in an axial direction away from said body member.

12. An adaptor as in claim 10 wherein each of said arms has a protrusion on a surface that contacts the container when the container is coupled to the adaptor.

13. An adaptor as in claim 10 wherein each of said plurality of arms are confined within a space between said outer ring and said holding element.

14. An adaptor for releasably securing a container having a fuel reservoir to a fuel consumption device, the adaptor comprising:

a tightening assembly including an inner locking element and an outer ring rotatable with respect to said inner locking element, said inner locking element including a plurality of flexible arms, each of said plurality of flexible arms including a flange, said tightening assembly having at least two configurations, a tightened configuration and a released configuration, said configurations dependent on a position of said outer ring with respect to said locking element; and a holding member arranged inwardly of said inner locking element, said holding member adapted for releasable engagement with a portion of said container when said tightening assembly is in at least said released configuration, wherein said flange is confined by a portion of said holding member, said flange restricting the movement of said arm in an axial direction.

15. An adaptor as in claim 14, further including a compressible sealing member positioned to provide a gas tight seal between said adaptor and the container.

16. An adaptor as in claim 14, wherein said holding member includes at least one prong shaped to engage a portion of the container.

17. An adapter as in claim 16, further comprising a plurality of prongs each of which are circumferentially positioned with respect to each other.

18. An adaptor as in claim 14, further comprising at least one o-ring for providing a gas tight seal around a nozzle of the container when said container is coupled to said adaptor.

19. An adaptor as in claim 14, wherein said adaptor includes an inner ledge, said inner ledge adapted to abut against a nozzle of the container when said holding member is engaged with the container.

20. An adaptor as in claim 14, wherein said tightening assembly is adapted to press said inner locking element against the container with a force that is dependent on a position of said outer ring with respect to said inner locking element.

21. An adaptor as in claim 20, wherein said tightening assembly includes a spring, said spring applying a rotating force to said outer ring in a direction towards said released configuration.

22. An adaptor as in claim 21, wherein said spring force is sufficient to place said outer ring in said released configuration when the adaptor is not coupled to the container and is insufficient to rotate said outer ring from said tightened configuration when the adaptor is coupled to the container.

23. An adaptor as in claim 14, wherein said locking element circumscribes a cylindrical portion of the container when the adaptor is coupled to the container.

24. An adaptor as in claim 23, wherein said locking element is flexible in the radially inward direction.

25. An adaptor as in claim 24, wherein said locking element includes a plurality of arms that are each flexible in the radially inward direction.

26. An adaptor as in claim 25, wherein a portion of said locking element is positioned underlying said holding element, said holding element restricting the bending of said plurality of arms in an axial direction.

27. An adaptor as in claim 25, wherein each of said arms has a protrusion on a surface that contacts the container when the container is coupled to the adaptor.

28. An adaptor as in claim 25 wherein each of said plurality of arms are confined within a space between said outer ring and said holding element.

29. An adaptor as in claim 14, wherein said inner locking element and said outer ring are both shaped to include detents positioned to restrict the rotation of said outer ring between said tightened configuration and said released configuration.

30. An adaptor as in claim 14, wherein said inner locking element includes detents, and said outer ring includes an engaging surface such that a signal is generated when said outer ring is rotated and said detents contact said engaging surface.

31. An adaptor as in claim 14, further including a container of fuel attached to said adaptor and a fuel consumption device attached to said adaptor for consumption of said fuel.

32. An adaptor as in claim 31, wherein said fuel consumption device comprises a torch.

33. A fuel consumption apparatus for producing a flame, said apparatus comprising:

a container for discharge of a fuel therefrom;

a fuel consumption device for producing a flame upon igniting said fuel; and an adaptor for releasably coupling said container to said fuel consumption device, said adaptor including a tightening assembly having an inner locking element and an outer ring rotatable with respect to said inner locking element, said tightening assembly operable between a locked position and an unlocked position, said inner locking element and said outer ring both including detents positioned to restrict the rotation of said outer ring between said locked and unlocked positions, and a holding member adapted for releasable engagement with a portion of said container when said tightening assembly is in at least said unlocked position.

34. An apparatus of claim 33, wherein said inner locking element includes a plurality of flexible arms.

35. An apparatus as in claim 34, wherein each of said plurality of flexible arms includes a flange, said flange being confined by a portion of said holding member, said flange restricting the movement of said arm in an axial direction.

36. An apparatus as in claim 33, further including a compressible sealing member positioned to provide a gas tight seal between said adaptor and the container.

37. An apparatus as in claim 33, wherein said holding member includes at least one prong shaped to engage a portion of the container.

38. An apparatus as in claim 37, further comprising a plurality of prongs each of which are circumferentially positioned with respect to each other.

39. An apparatus as in claim 33, further comprising at least one o-ring for providing a gas tight seal around a nozzle of the container when said container is coupled to said adaptor.

40. An apparatus as in claim 33, wherein said adaptor includes an inner ledge, said inner ledge adapted to abut against a nozzle of the container when said holding member is engaged with the container.

41. An apparatus as in claim 33, wherein said tightening assembly is adapted to press said inner locking element against the container with a force that is dependent on a position of said outer ring with respect to said inner locking element.

42. An apparatus as in claim 33, wherein said locking element includes a plurality of arms that are each flexible in the radially inward direction.

43. An apparatus as in claim 42, wherein a portion of said locking element is positioned underlying said holding element, said holding element restricting the bending of said plurality of arms in an axial direction.

44. A apparatus as in claim 42, wherein each of said arms has a protrusion on a surface that contacts the container when the container is coupled to the adaptor.

45. An apparatus as in claim 42 wherein each of said plurality of arms are confined within a space between said outer ring and said holding element.

46. An apparatus as in claim 33, wherein said fuel consumption device comprises a torch.

47. An apparatus as in claim 33, wherein said inner locking element includes a plurality of flexible arms, said arms biased radially inward whereby coupling said container to said adaptor causes said fingers to flex radially outward.

48. An apparatus as in claim 47, wherein each of said fingers include an inwardly facing edge adapted for engagement with a portion of said container when received within said adaptor.

49. An apparatus as in claim 47, wherein said tightening assembly includes a spring, said spring applying a rotating force to said outer ring in a direction towards said unlocked position.

50. A method for releasably securing a container having a fuel reservoir to a fuel consumption device, said method comprising providing a tightening assembly having an inner locking element and an outer ring rotatable with respect to said inner locking element, said inner locking element including a plurality of flexible arms each including a flange, said tightening assembly having a tightened configuration and a released configuration dependent on a position of said outer ring relative to said inner locking element, providing a holding member inwardly of said inner locking element, arranging said tightening assembly in said released configuration, engaging a portion of said container within said holding member with said tightening assembly in said released configuration, rotating said outer ring relative to said inner locking element for arranging said tightening assembly in said tightened configuration, and confining said flange by a portion of said holding member, said flange restricting the movement of said arm in an axial direction.

51. A method as in claim 50, wherein said holding member includes a plurality of prongs shaped to engage a portion of the container, said prongs circumferentially positioned with respect to each other.

52. A method as in claim 50, further including abutting a nozzle of the container against a ledge when said holding member is engaged with the container for discharge of fuel from said container.

53. A method as in claim 50, wherein said tightening assembly includes a spring, said spring applying a rotating force to said outer ring in a direction towards said released configuration.

54. A method as in claim 53, wherein said spring force is sufficient to place said outer ring in said released configuration when said holding member is not coupled to the container and is insufficient to rotate said outer ring from said tightened configuration when said holding member is coupled to the container.

55. A method as in claim 50, wherein said fuel consumption device comprises a torch.

56. An adaptor for releasable securing a container having a fuel reservoir and an elongated nozzle for discharge of fuel therefrom to a fuel consumption device, the container having a recess at one end of the container, the adaptor comprising:

a body member having a passageway for receiving the elongated nozzle, said passageway adapted for communicating between the fuel reservoir and the fuel consumption device when the adaptor is coupled to the container;

a holding member attached to said body member and shaped to engage the container recess for securing the container in a predetermined position with respect to said body member with said nozzle received within said passageway; and a tightening assembly having an inner locking element and an outer ring rotatable with respect to said inner locking element, said tightening assembly operative between a locked and unlocked position to press said inner locking element against the container with a force that is dependent on a position of said outer ring with respect to said inner locking element, said locking element circumscribing a cylindrical portion of the container when the adaptor is coupled to the container, said locking element including a plurality of arms that are each flexible in the radially inward direction, wherein a portion of said locking element is positioned between said holding element and said body member, said holding element restricting the movement of said plurality of arms in an axial direction away from said body member.

57. An adaptor for releasable securing a container having a fuel reservoir and an elongated nozzle for discharge of fuel therefrom to a fuel consumption device, the container having a recess at one end of the container, the adaptor comprising:

a body member having a pass ageway for receiving the elongated nozzle, said passageway adapted for communicating between the fuel reservoir and the fuel consumption device when the adaptor is coupled to the container;

a holding m ember attached to said body member and shaped to engage the container recess for securing the container in a predetermined position with respect to said body member with said nozzle received within said passageway; and a tightening assembly having an inner locking element and an outer ring rotatable with respect to said inner locking element, said tightening assembly operative between a locked and unlocked position to press said inner locking element against the container with a force that is dependent on a position of said outer ring with respect to said inner locking element, said locking element circumscribing a cylindrical portion of the container when the adaptor is coupled to the container, said locking element including a plurality of arms that are each flexible in the radially inward direction, wherein each of said arms has a protrusion on a surface that contacts the container when the container is coupled to the adaptor.

58. An adaptor for releasably securing a container having a fuel reservoir to a fuel consumption device, the adaptor comprising:

a tightening assembly including an inner locking element and an outer ring rotatable with respect to said inner locking element, said inner locking element including a plurality of flexible arms, said tightening assembly having at least two configurations, a tightened configuration and a released configuration, said configurations dependent on a position of said outer ring with respect to said locking element, each of said plurality of flexible arms having a contact surface for pressing against the container when the container is coupled to the adaptor with said tightening assembly in said tightened configuration, each of said contact surfaces having a small protrusion; and a holding member arranged inwardly of said inner locking element, said holding member adapted for releasable engagement with a portion of said container when said tightening assembly is in at least said released configuration.

59. An adaptor for releasably securing a container having a fuel reservoir to a fuel consumption device, the adaptor comprising:

a tightening assembly including an inner locking element and an outer ring rotatable with respect to said inner locking element, said tightening assembly having at least two configurations, a tightened configuration and a released configuration, said configurations dependent on a position of said outer ring with respect to said locking element, said tightening assembly adapted to press said inner locking element against the container with a force that is dependent on a position of said outer ring with respect to said inner locking element, said tightening assembly including a spring applying a rotating force to said outer ring in a direction towards said released configuration; and a holding member arranged inwardly of said inner locking element, said holding member adapted for releasable engagement with a portion of said container when said tightening assembly is in at least said released configuration.

60. An adaptor for releasably securing a container having a fuel reservoir to a fuel consumption device, the adaptor comprising:

a tightening assembly including an inner locking element and an outer ring rotatable with respect to said inner locking element, said locking element circumscribing a cylindrical portion of the container when the adaptor is coupled to the container, said locking element being flexible in the radially inward direction, said locking element including a plurality of arms that are each flexible in the radially inward direction, said tightening assembly having at least two configurations, a tightened configuration and a released configuration, said configurations dependent on a position of said outer ring with respect to said locking element; and a holding member arranged inwardly of said inner locking element, said holding member adapted for releasable engagement with a portion of said container when said tightening assembly is in at least said released configuration, wherein a portion of said locking element is positioned underlying said holding element, said holding element restricting the bending of said plurality of arms in an axial direction.

61. An adaptor for releasably securing a container having a fuel reservoir to a fuel consumption device, the adaptor comprising:

a tightening assembly including an inner locking element and an outer ring rotatable with respect to said inner locking element, said locking element circumscribing a cylindrical portion of the container when the adaptor is coupled to the container, said locking element being flexible in the radially inward direction, said locking element including a plurality of arms that are each flexible in the radially inward direction, wherein each of said arms has a protrusion on a surface that contacts the container when the container is coupled to the adaptor, said tightening assembly having at least two configurations, a tightened configuration and a released configuration, said configurations dependent on a position of said outer ring with respect to said locking element; and a holding member arranged inwardly of said inner locking element, said holding member adapted for releasable engagement with a portion of said container when said tightening assembly is in at least said released configuration.

62. An adaptor for releasably securing a container having a fuel reservoir to a fuel consumption device, the adaptor comprising:

a tightening assembly including an inner locking element and an outer ring rotatable with respect to said inner locking element, said tightening assembly having at least two configurations, a tightened configuration and a released configuration, said configurations dependent on a position of said outer ring with respect to said locking element, said inner locking element and said outer ring both shaped to include detents positioned to restrict the rotation of said outer ring between said tightened configuration and said released configuration; and a holding member arranged inwardly of said inner locking element, said holding member adapted for releasable engagement with a portion of said container when said tightening assembly is in at least said released configuration.

63. An adaptor for releasably securing a container having a fuel reservoir to a fuel consumption device, the adaptor comprising:

a tightening assembly including an inner locking element and an outer ring rotatable with respect to said inner locking element, said tightening assembly having at least two configurations, a tightened configuration and a released configuration, said configurations dependent on a position of said outer ring with respect to said locking element, said inner locking element including detents, and said outer ring including an engaging surface such that a signal is generated when said outer ring is rotated and said detents contact said engaging surface; and a holding member arranged inwardly of said inner locking element, said holding member adapted for releasable engagement with a portion of said container when said tightening assembly is in at least said released configuration.

64. A fuel consumption apparatus for producing a flame, said apparatus comprising:

a container for discharge of a fuel therefrom;

a fuel consumption device for producing a flame upon igniting said fuel; and an adaptor for releasably coupling said container to said fuel consumption device, said adaptor including a tightening assembly having an inner locking element and an outer ring rotatable with respect to said inner locking element, said inner locking element including a plurality of flexible arms, each of said plurality of flexible arms including a flange, said tightening assembly operable between a locked position and an unlocked position, and a holding member adapted for releasable engagement with a portion of said container when said tightening assembly is in at least said unlocked position, wherein said flange is confined by a portion of said holding member, said flange restricting the movement of said arm in an axial direction.

65. A fuel consumption apparatus for producing a flame, said apparatus comprising:

a container for discharge of a fuel therefrom;

a fuel consumption device for producing a flame upon igniting said fuel; and an adaptor for releasably coupling said container to said fuel consumption device, said adaptor including a tightening assembly having an inner locking element and an outer ring rotatable with respect to said inner locking element, said locking element including a plurality of arms that are each flexible in the radially inward direction, said tightening assembly operable between a locked position and an unlocked position, and a holding member adapted for releasable engagement with a portion of said container when said tightening assembly is in at least said unlocked position, wherein a portion of said locking element is positioned underlying said holding element, said holding element restricting the bending of said plurality of arms in an axial direction.

66. A fuel consumption apparatus for producing a flame, said apparatus comprising:

a container for discharge of a fuel therefrom;

a fuel consumption device for producing a flame upon igniting said fuel; and an adaptor for releasably coupling said container to said fuel consumption device, said adaptor including a tightening assembly having an inner locking element and an outer ring rotatable with respect to said inner locking element, said locking element including a plurality of arms that are each flexible in the radially inward direction, each of said arms having a protrusion on a surface that contacts the container when the container is coupled to the adaptor, said tightening assembly operable between a locked position and an unlocked position, and a holding member adapted for releasable engagement with a portion of said container when said tightening assembly is in at least said unlocked position.

67. A fuel consumption apparatus for producing a flame, said apparatus comprising:

a container for discharge of a fuel therefrom;

a fuel consumption device for producing a flame upon igniting said fuel; and an adaptor for releasably coupling said container to said fuel consumption device, said adaptor including a tightening assembly having an inner locking element and an outer ring rotatable with respect to said inner locking element, said inner locking element including a plurality of flexible arms, said arms biased radially inward whereby coupling said container to said adaptor causes said fingers to flex radially outward, said tightening assembly operable between a locked position and an unlocked position, and a holding member adapted for releasable engagement with a portion of said container when said tightening assembly is in at least said unlocked position.

68. A method for releasably securing a container having a fuel reservoir to a fuel consumption device, said method comprising providing a tightening assembly having an inner locking element and an outer ring rotatable with respect to said inner locking element, said tightening assembly having a tightened configuration and a released configuration dependent on a position of said outer ring relative to said inner locking element, said tightening assembly including a spring applying a rotating force to said outer ring in a direction towards said released configuration; providing a holding member inwardly of said inner locking element; arranging said tightening assembly in said released configuration; engaging a portion of said container within said holding member with said tightening assembly in said released configuration; and rotating said outer ring relative to said inner locking element for arranging said tightening assembly in said tightened configuration.

* * * * *

UNITED STATES PATENT AND TRADEMARK OFFICE

CERTIFICATE OF CORRECTION

PATENT NO. : 6,959,742 B2
APPLICATION NO. : 10/356420
DATED : November 1, 2005
INVENTOR(S) : Louis V. Aronson, II and Adam Grabicki It is certified that error appears in the above-identified patent and that said Letters Patent is hereby corrected as shown below:

Title page,
Item [75], Inventors, insert -- II -- after "Aronson".

Column 1,
Line 26, replace "desireable" with -- desirable --.

Column 2,
Line 54, replace "passed" with -- past --.
Line 62, after "passageway" insert -- being --.

Column 3,
Lines 13 and 60, after "configurations" insert -- being --.

Column 4,
Line 31, insert -- The above description, as well as further objects, features and advantages of the present invention will be more fully understood with reference to the following detailed description of a fuel transfer adaptor, when taken in conjunction with the accompanying drawings, wherein: --.

Column 5,
Line 38, "th e" should read -- the --.

Column 6,
Lines 47 and 51, "are" should read -- is --.

Column 7,
Line 25, "finger" should read -- fingers --.

Column 8,
Line 5, "prevents" should read -- prevent --.

Column 9,
Line 18, after "154" insert -- comma --.

Column 10,
Line 41, "releasable" should read -- releasably --.

UNITED STATES PATENT AND TRADEMARK OFFICE

CERTIFICATE OF CORRECTION

PATENT NO. : 6,959,742 B2
APPLICATION NO. : 10/356420
DATED : November 1, 2005
INVENTOR(S) : Louis V. Aronson, II and Adam Grabicki It is certified that error appears in the above-identified patent and that said Letters Patent is hereby corrected as shown below:

Column 11,
Line 7, “adapter” should read -- adaptor --.
Lines 8 and 41, “are” should read -- is --.
Line 53, after “figurations” insert -- being --.

Column 12,
Line 1, “adapter” should read -- adaptor --.
Line 41, “are” should read -- is --.

Column 13,
Line 10, “of” should read -- as in --.
Line 23, “are” should read -- is --.
Line 45, “A” should read -- a --.
Line 49, “are” should read -- is --.
Line 58, “include” should read -- includes --.

Column 14,
Lines 35 and 66, “releasable” should read -- releasably --.

Column 15,
Line 4, “pass ageway” should read -- passageway --.
Line 9, “m ember” should read -- member --.
Lines 36 and 57, after “configurations” insert -- being --.

UNITED STATES PATENT AND TRADEMARK OFFICE

CERTIFICATE OF CORRECTION

PATENT NO. : 6,959,742 B2
APPLICATION NO. : 10/356420
DATED : November 1, 2005
INVENTOR(S) : Louis V. Aronson, II and Adam Grabicki It is certified that error appears in the above-identified patent and that said Letters Patent is hereby corrected as shown below:

Column 16,
Lines 17, 41 and 56, after "configurations" insert -- being --.

Column 17,
Line 8, after "configurations" insert -- being --.

Signed and Sealed this

Twentieth Day of June, 2006

JON W. DUDAS
*Director of the United States Patent and Trademark Office*